US007408106B2

(12) United States Patent
Weiner et al.

(10) Patent No.: US 7,408,106 B2
(45) Date of Patent: Aug. 5, 2008

(54) TELE-KARAOKE

(75) Inventors: Moshe Weiner, Kiron (IL); Erez Reinshmidt, Kadima (IL)

(73) Assignee: Comverse Ltd., Tel Aviv (IL)

( * ) Notice: Subject to any disclaimer, the term of this patent is extended or adjusted under 35 U.S.C. 154(b) by 1435 days.

(21) Appl. No.: 09/892,767

(22) Filed: Jun. 28, 2001

(65) Prior Publication Data

US 2003/0019347 A1 Jan. 30, 2003

(51) Int. Cl.
*G10H 1/36* (2006.01)
*G10H 7/00* (2006.01)

(52) U.S. Cl. ..... 84/610; 84/601; 84/609; 84/634; 84/477 R

(58) Field of Classification Search ..... 84/600–603, 84/609–610, 634, 649–650, 666; 434/307 A
See application file for complete search history.

(56) References Cited

U.S. PATENT DOCUMENTS 5,555,017 A * 9/1996 Landante et al. ..... 348/14.09
5,564,001 A * 10/1996 Lewis ..... 707/500.1
5,953,005 A * 9/1999 Liu ..... 434/307 A
6,288,319 B1 * 9/2001 Catona ..... 84/609
6,308,204 B1 * 10/2001 Nathan et al. ..... 709/221

* cited by examiner

*Primary Examiner*—Marlon T Fletcher
(74) *Attorney, Agent, or Firm*—Sughrue Mion, PLLC

(57) ABSTRACT

A system and method of tele-karaoke that enables a user to perform and record karaoke using a terminal such as a cellular telephone. The karaoke performance is recorded as an MMS message which subsequently allows a user to send the recorded performance to others. The system allows users to record their karaoke performance is less public forums and without any specialized equipment other than a cellular telephone or a personal computer. Since the karaoke performance is recorded as an MMS message, it can be edited to incorporate various media and sent to others at subsequent times.

5 Claims, 4 Drawing Sheets

TELE-KARAOKE

BACKGROUND OF THE INVENTION

1. Field of the Invention

The present invention relates generally to a multimedia messaging service ("MMS") application and more specifically to using a multimedia messaging service based application to record and send telephone or PC karaoke performances to another user.

2. Description of Related Art

Multimedia messaging service is the ability to send and receive messages comprising a combination of text, sounds, images and video to MMS capable handsets and computers. MMS is a component that can be connected to all possible networks such as cellular networks, broad band networks, fixed line and Internet networks. As technology has evolved so has the needs of its users. Users, such as cellular telephone users, demand more out of their messaging service. They require the ability to send and received such items as business cards, post cards and pictures.

Accordingly, MMS was developed to enhance the messaging based on the users' new demands. In the 3G cellular ($3^{rd}$ generation of cellular communication specifications) architecture, MMS has been added. As stated above, this allows users of cellular telephone to send and receive messages exploiting the whole array of media types while also making it possible to support new content types as they become popular. MMS is well known in the telecommunications world and has been standardized (see Standard 23.140 of the 3 GPP-3G Partnership Project at www.3gpp.org, incorporated herein by reference for a further explanation of MMS).

Before MMS there existed karaoke. As most people are well aware, karaoke is basically people singing along with music of a known song while the words of the song are not played or played at a significantly lower volume than the music. Occurring synchronously to the music, a karaoke terminal displays the words to the song which consequently allows a user to sing the words of the song even if the user does not know the words. The karaoke terminal not only displays the words to the song but also synchronizes the displaying of the words of the song with the music so that a user knows precisely when each word of the song should be sung. Said differently, the karaoke terminal displays the words of the song synchronously with the music of the song being played so that a person can sing the words to the song.

Prior to the present invention, users who desired to "karaoke" needed specially manufactured karaoke equipment or at least a personal computer with special karaoke software. Additionally, the user would be limited to when and where the user could perform karaoke of a particular song. Furthermore, prior to the present invention users had limited ways of recording their performance so that others could subsequently experience the user's performance. In order to record a karaoke performance, the user was forced to use equipment such as a tape recorder in addition to the karaoke terminal. This method of recording lacked in quality and convenience.

Moreover, if the user wished to send a copy of the performance to another person, the user was forced to use yet another piece of equipment to make a copy of the performance. Once a copy was made, the user had to physically send the performance to the person with whom the user wished to share the performance with. This process was extremely difficult, inconvenient and required special equipment that a majority of users did not possess. The inconvenience and difficulty of recording, copying and sending karaokes performances deterred users from even attempting to share the performances with others who were not physically present at the time of the performance.

Additionally, many users who enjoy performing karaoke do not enjoy performing in front of others. Prior to the present invention, karaoke was primarily available at public forums. The public nature of karaoke also deterred users from performing.

SUMMARY OF THE INVENTION

Therefore, it has become desirable to provide a karaoke terminal that allows a user to perform but does not require additional and special karaoke equipment. Furthermore, it has become desirable to provide a karaoke terminal that is portable so that a user may perform at any location (public or private) and possess the ability to record the user's performance without additional and special equipment. Finally, it has become desirable to provide a karaoke system that allows the user the ability to treat the performance as a message which in turn allows the user to send copies of the performance to others through the user's cellular telephone or personal computer.

The present invention provides an application for MMS which allows a user to perform karaoke using the user's cellular telephone or personal computer and have the performance recorded as a message that can subsequently be sent to another user.

The present invention solves the above-described problems by enabling a user to operate the user's cellular telephone or personal computer as a karaoke terminal. First, cellular telephones and personal computers are available to the general public relatively inexpensively. Furthermore, a vast majority of people have access to at least one of these devices which makes using it as a karaoke terminal convenient. Second, using cellular telephones or personal computers as karaoke terminals allows the user to chose when, where and in front of whom the user performs. This allows shy users to enjoy karaoke while not having to perform publicly. Finally, through the use of MMS, the user's performance can be recorded without requiring special equipment. It also allows the performance to be treated as a message which can be subsequently sent to other users as conveniently as forwarding an email message.

In a preferred embodiment of the present invention, a user can order a specific song from his Tele-Karaoke service provider using his cellular telephone. The song is retrieved from a Tele-Karaoke server and provided to the user with the synchronized words so that the user can perform karaoke of the requested song. The performance is recorded and stored by a multimedia messaging server in a storage space within the multimedia messaging server which is dynamically allocated to the user as needed. With the performance recorded in MMS form, the user can subsequently chose to listen to the performance and/or have a copy of the performance sent to a friend (another user) so that the friend can listen and enjoy the user's performance.

In another embodiment of the present invention, the user can use a personal computer or a fixed telephone to gain access to the Tele-Karaoke server which is located at the premises of the Tele-Karaoke service provider. For example, the computer can be connected to the Tele-Karaoke server via a fixed telephone line or another line such as a coaxial cable, fiber optic cable or cellular modem. Additionally, a fixed telephone can be upgraded to have a display and other features that today are used for cellular telephones. Accordingly, the fixed telephone will be able to provide the services that the cellular telephone does for the present invention.

In yet another embodiment of the present invention, the user's performance is recorded not only in audio but also in video using a video recording device.

In still another embodiment of the present invention, the user can access his performance and edit or add text or other effects to the performance after the performance has been recorded. For example, the user can use his performance as the audio and use a different video.

Further objects, features and advantages of the invention will become apparent from a consideration of the following description and the appended claims when taken in connection with the accompanying drawings.

BRIEF DESCRIPTION OF THE DRAWINGS

The above aspects of the present invention will become more apparent by describing in detail embodiments thereof with reference to the attached drawings, in which.

DETAILED DESCRIPTION OF THE PREFERRED EMBODIMENTS

Hereinafter, embodiments of the present invention will be described in detail with reference to the attached drawings. The present invention is not restricted to the following embodiments, and many variations are possible within the spirit and scope of the present invention. The embodiments of the present invention are provided in order to more completely explain the present invention to one skilled in the art.

Figure 1:
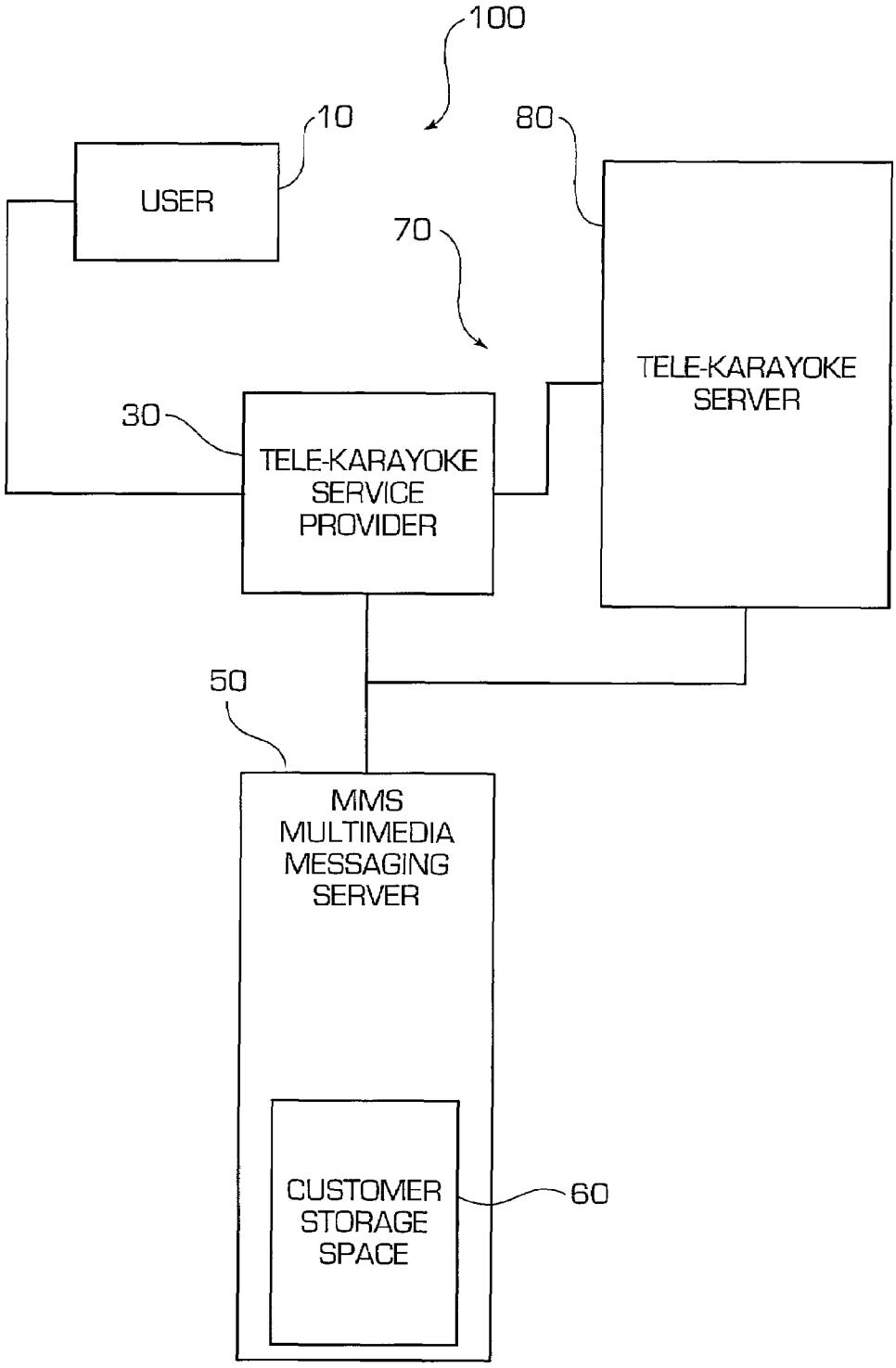
FIG. 1 is a block diagram illustrating the interrelationships between the components of the Tele-Karaoke system of the present invention.

Referring to FIG. 1, a user 10 accesses a Tele-Karaoke service provider 30. In a preferred embodiment, the user accesses the Tele-Karaoke service provider 30 by calling a specific number using his cellular telephone. In addition, the Tele-Karaoke service provider 30 may require some sort of user identification which would allow the Tele-Karaoke service provider 30 to charge a fee for providing the service, although this is not necessary in the present invention. For example, the Tele-Karaoke service provider 30 may require the user to enter a pre-assigned password or a credit card number before allowing access. The Tele-Karaoke service provider 30 can use calling line ID (CLI) to identify the user and automatically charge the user 10, either through the users telephone account or another account, such as a pre-established credit card account, correlated to the user. The Tele-Karaoke service provider 30 allows the user 10 to choose a specific song among a library of different songs. In a preferred embodiment, the songs are categorized and the user 10 chooses a specific song using the category of the music desired as well as the title of the song or the artist of the song. The songs are presented to the user 10 by, for example, a WAP browser that enables the user to view the text information corresponding to various songs.

Once the user 10 chooses the desired song from the Tele-Karaoke service provider 30, the Tele-Karaoke service provider 30 retrieves the song and synchronized text from the Tele-Karaoke server 80. In a preferred embodiment, music and text for each song are stored and correlated. The user's cellular telephone uses a protocol called SMIL (Synchronized Multimedia Integration Language) to enable the user's phone to play music and display correlated text at the same time (see SMIL Specification as http://www.w3.org/TR/REC-smil, incorporated herein by reference, for more information on SMIL).

The user 10 hears the music using a headset or attachable ear piece and reads the text (i.e. the song's words) from the display. At this stage the user 10 sings along with the music. The telephone has a microphone and the words sung by the user are captured by the microphone. Furthermore, the tele-karaoke server 80 is the source of the music and text that are sent to the user 10. When the Tele-Karaoke server 80 receives the words sung by the user 80, it combines them with the rest of the content of the original song (the music and the text) into one multi media entity and temporarily keeps (caches) it within the server. Said differently, the Tele-Karaoke server 80 records the user's singing and then electronically combines the user's singing with the original multimedia stream. However, since there is a delay between the user's singing and the time the original stream was sent, a delay must be inserted to the user's singing when combining the user's singing with the original stream. The Tele-Karaoke server 80 calculates the delay by using the user's singing performance. The music of the original stream can be faintly heard in the background of the user's singing performance and as such, the delay necessary is calculated and inserted by the Tele-Karaoke server 80 based on the time difference between the original stream and the user's recorded stream.

In another embodiment, a supplemental multimedia device is attached to the user's cellular telephone that records the karaoke stream (music and text) from the Tele-Karaoke server 80. Then, the user 10 accesses the Tele-Karaoke server 80 through the Tele-Karaoke service provider 30 and the attached multimedia device plays the music and displays the texts using the SMIL protocol as described above. The Tele-Karaoke server 80 records both the user's singing and the multimedia stream (the music and text) together as a single stream. Since the multimedia stream and the user's singing occur at the same time, the Tele-Karaoke server 80 does not combine two streams, only records a single performance-music, singing, and text together as one multimedia stream.

Then, when the song has finished, the Tele-Karaoke server 80 prompts the user by using an IVR (Interactive voice response) to provide the server 80 with a destination number where the recorded song should be sent. After the input of the destination number, the Tele-Karaoke server 80 forwards the multi media entity to the MMS 50 for handling as a multi media message and forwarding it to its destination. The user 10 can also choose to keep the recorded song. In this case the MMS 50 will forward the song to the customer storage server 60.

The music of the ordered song as well as the text of the words and performance by the user 10 is stored on the MMS multimedia messaging server 50. The MMS multimedia messaging server 50 is a standard device in the telecommunication world (see standard 23.140 of the 3GPP-3G partnership Project at www.3gpp.org).

In order to store performances, within the MMS server 50 each user 10 has its own personal customer storage space 60. The user 10 can sing the karaoke song he has ordered and record it at his customer storage space 60 within the MMS multimedia messaging server 50. The recorded performance which is stored in the customer storage space 60 within the MMS multimedia messaging server 50 can then be accessed by the user 10 in order to allow the user 10 to listen to the performance.

The user 10 is identified by the Tele-Karaoke server 80 by its MSISDN (its telephone number). Once the user has been registered to have the Tele-Karaoke service, the operator assigns a storage place for the specified telephone number within the customer storage server 80. The customer can access its storage place in a manner similar to accessing voice mail today. The customer 10 can dial a number (e.g. *151) and be connected to the multi media storage server 50 or to the MMS 50 that is connected to the customer storage server 60.

Also, from the customer storage space 60 within the MMS multimedia messaging server 50, a user 10 can send the recorded performance to a friend or other acquaintance in much the same manner as one would forward a voicemail message to another person. For example, after a karaoke performance is recorded, the performance is stored as a multimedia message that includes music, voice of the user 10 and text (optional) of the song's words. The Tele-Karaoke server 80 has a database of various songs. This database includes audio information (the music of the song) and text information (the words of the song). These two medias can be synchronized using existing technologies such as SMIL protocol etc. Now, when the user 10) has chosen a song, the Tele-Karaoke server 80 sends a multimedia content that includes these two media or more (e.g. also video information that includes a clip of the song etc). Thus, the text is part of the initial content and after the user sings the song, another media can be added (voice). All media is combined into a multi media entity.

Such a message is stored within the MMS multimedia messaging server 50. A user 10 then enters the telephone number of a friend to whom the user 10 would like to send the recorded performance. For example, when the song has finished the Tele-Karaoke server 80 prompts the user by using an IVR (Interactive voice response) to provide the server 80 with the destination number that the recorded song should be sent. After the input of the destination number, the Tele-Karaoke server 80 forwards the multi media entity to the MMS 50 as a multi media message and forwards it to its destination. The user 10 can also choose to keep the recorded song for a while. In this case the MMS 50 will forward the song to the customer storage server 60. After a while the user 10 can ring the access number to the MMS and then the MMS 50 prompts the user to input what the user 10 would like to send and to whom. The content that should be sent can be taken from the customer storage server 60. The friend receives the recorded performance as a MMS message which allows the friend to listen to the performance exactly as it was recorded.

Figure 2A:
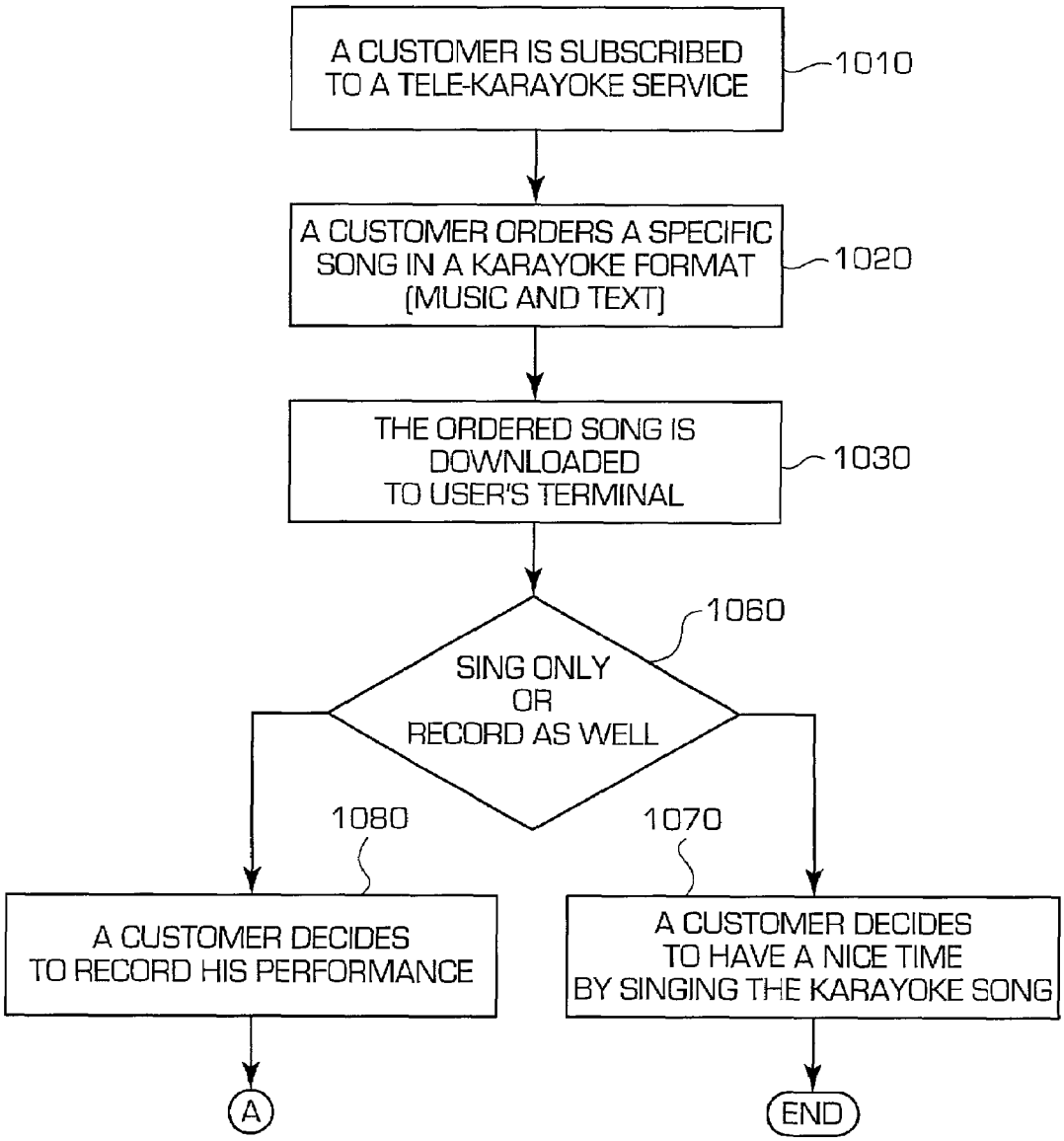
FIGS. 2(*a*) and 2(*b*) show a flow chart of the process of the present invention.
Figure 2B:
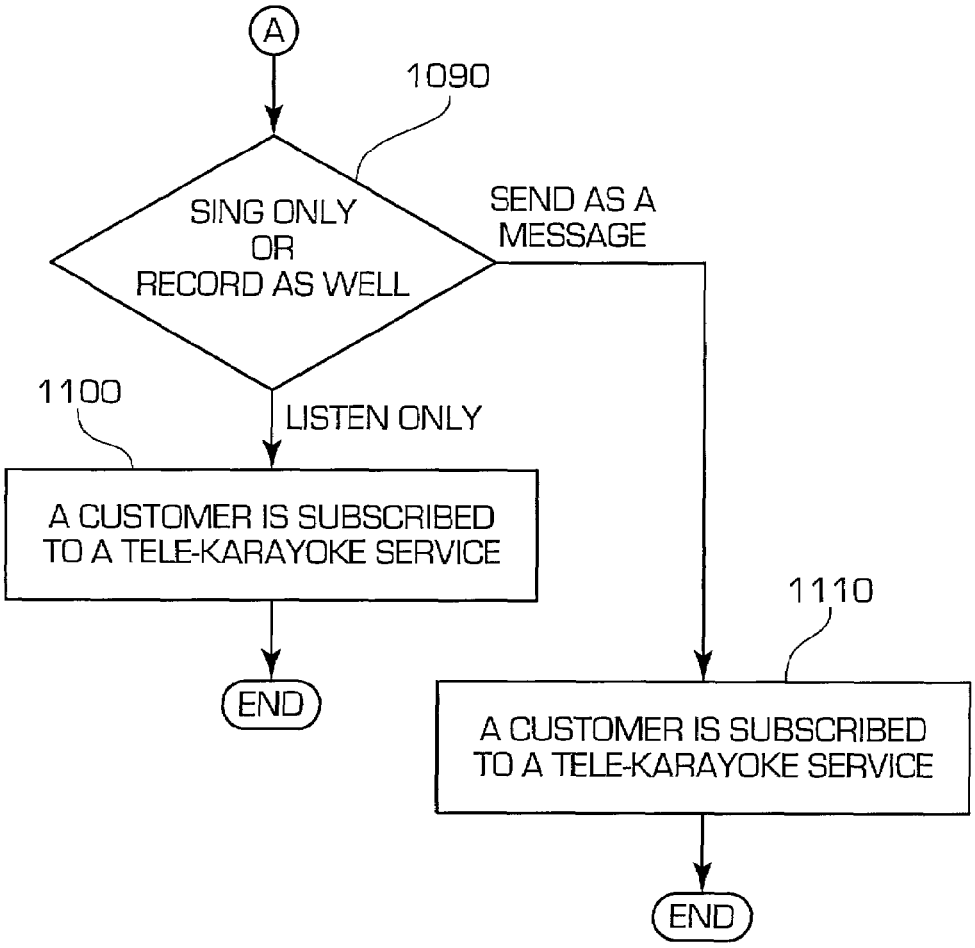

Referring to FIGS. 2(*a*) and 2(*b*), the process according to a preferred embodiment of the present invention is shown, although this process should not be considered as limiting the present invention. A user 10 subscribes to a Tele-Karaoke service provider 30 by, for example, gaining access through the use of a cellular telephone 1010. The user 10 then orders a specific song in Karaoke format by using a selection system that the Tele-Karaoke service provider 30 provides 1020. For example, the user 10 rings into the Tele-Karaoke service provider 30. The call gets to the Tele-Karaoke server 80. This server has an IVR system. This system is a voice interactive system that says for example: "for pop music please press 1, for rock n roll press 2 for disco press 3, for songs from the 90s press 11, for 80s press 22" etc. The user gets to hear the variety of songs listed by their names, within the group that he has chosen, for example "'Singing in the Rain' press 100, for 'Love of My Life' press 200" etc. This system can also use speech recognition to select the categories and song titles instead of or in conjunction with having the user 10 press buttons.

The Tele-Karaoke service provider 30 retrieves the ordered song from the Tele-Karaoke server 80. The ordered song is then downloaded to the user's 10 terminal which in a preferred embodiment is a cellular telephone 1030. As stated previously, the user's cellular telephone uses the SMIL protocol to synchronously play the music and display the text.

Once the ordered song had been downloaded to the user's 10 terminal, the user 10 is given the option to have the performance recorded or merely sing along for fun without recording the performance 1060. If the user 10 chooses not to have his performance recorded, the song in karaoke format is played and the user 10 can sing along 1070. Once the song is over, the user 10 is considered to be finished with the specific session although the user 10 may be given the opportunity to order another song, at which point the process repeats starting at 1020.

If the user 10 chooses to have his performance recorded, the song in karaoke format is played and recorded while the user 10 sings along 1080. After the performance, the user 10 is then given the option to listen to the recorded performance or to send it as a message to a friend 1090. If the user 10 chooses to listen to the performance then the user 10 hears the recorded performance 1100. After hearing the performance, the session for that user 10 is considered to be over although in other embodiments, the user 10 is given the option to edit, store, delete, send or chose another song to record.

If the user 10 chooses to send the recorded performance to a friend, the stored performance will be treated as a multimedia message and will be sent as such 1110. After the message has been sent, the session for the user 10 is considered to be over although in other embodiments of the present invention, the user 10 may be given additional options such as listening to, storing, editing or deleting his recorded performance. The user 10 may also be given the option to send the recorded message to another person at a later time or to choose another song to record.

Figure 3:
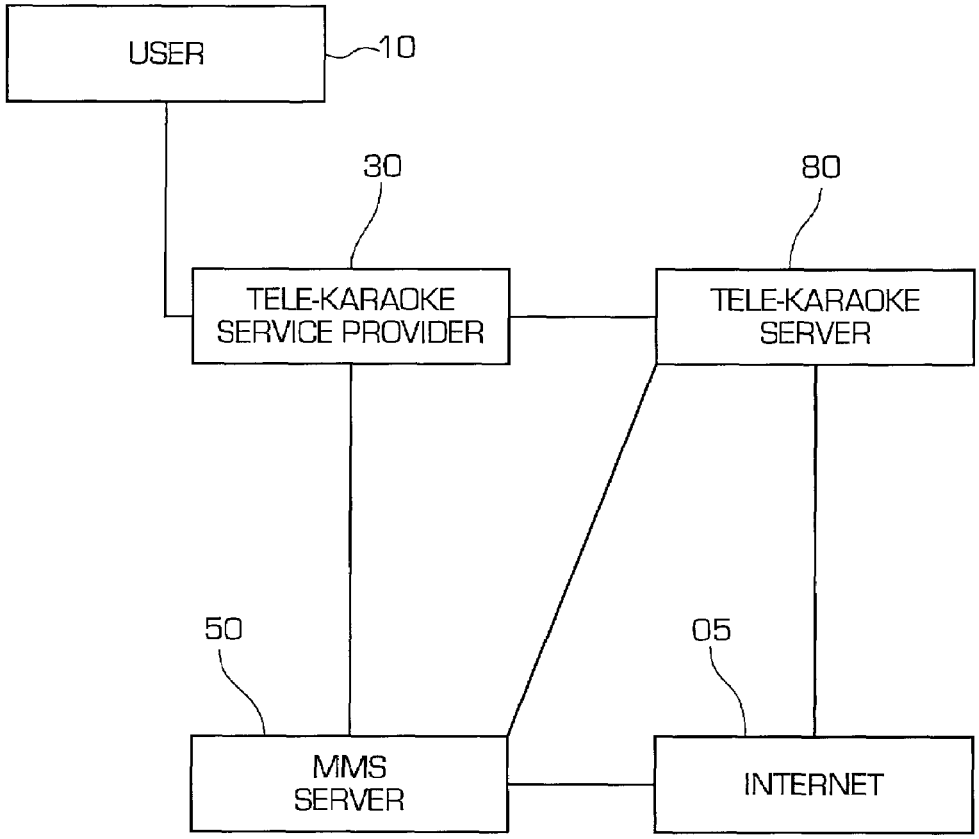
FIG. 3 is a block diagram illustrating another embodiment of the invention.

Although the above described a preferred embodiment, other embodiments are also available. For example, in another embodiment of the present invention, the user 10 may be given the option to access previously recorded performances once the user has gained access to the Tele-Karaoke service provider 30. The user 10 could also be allowed to download a previously recorded performance and to use other applications to edit the performance. For example, the user may wish to add video footage to a previous audio performance. One way to do this, as shown in FIG. 3, is for the user 10 to enter a website through a computer (e.g. PC) where the stored recorded performance can be retrieved (the MMS is accessible via the Internet). Once accessed, editing software can be employed to edit this multimedia message, and to add other media types, such as video. Cellular telephones that run an operating system may also perform the same editing function as the computer although a proprietary telephone that was built to support Tele-Karaoke does not have to have an operating system. Since the present invention uses MMS technology, the performances can be recorded in any type or combination of media and sent as a message.

While the present invention has been described in connection with a preferred embodiment, those skilled in the art will understand that the present invention may be implemented with various modifications to the preferred embodiment. For example, the Tele-Karaoke server 80 can be combined with the MMS server 50 so that the present invention is implemented using only one server.

What is claimed is:

1. A tele-karaoke system for performing karaoke comprising:

a tele-karaoke server storing a plurality of songs in karaoke format;

a user interface allowing a user to select a song in karaoke format from said tele-karaoke server in order to perform the song as a karaoke performance; and an MMS multimedia messaging server recording the karaoke performance as an MMS message;

wherein said MMS multimedia messaging server includes a customer storage space to store recorded tele-karaoke performances of the user;

wherein the MMS multimedia messaging server allows the user to at least one of send, store, edit and listen to the recorded performance as a message to another;

wherein the user edits the recorded message by adding at least one of text and video.

2. A method for allowing a user to perform karaoke comprising:

downloading a chosen song in karaoke format from a tele-karaoke server;

performing karaoke on the chosen song; and recording the performed karaoke by a MMS multimedia messaging server as an MMS message;

wherein prior to downloading, accessing a tele-karaoke service provider to choose the song;

choosing the song through the tele-karaoke service provider; and retrieving the chosen song to be downloaded from the tele-karaoke server by the tele-karaoke service provider;

wherein after recording the performed karaoke by an MMS multimedia messaging server as a message, editing the message of the recorded performance by adding at least one of text and video.

3. A method for recording karaoke performances as an MMS message, comprising:

storing a plurality of songs in karaoke format; and recording a selected one of said songs as an MMS message further comprising editing the recorded MMS message, wherein editing the recorded MMS message includes adding text.

4. A method for recording karaoke performances as an MMS message, comprising:

storing a plurality of songs in karaoke format; and recording a selected one of said songs as an MMS message further comprising editing the recorded MMS, wherein editing the recorded MMS message includes adding video.

5. The method of claim 3, wherein editing the recorded MMS message further includes adding video.

* * * * *